US008413389B2

(12) United States Patent
Frigerio

(10) Patent No.: US 8,413,389 B2
(45) Date of Patent: Apr. 9, 2013

(54) OPENABLE COVERING CONSTRUCTION FOR PERGOLAS, VERANDAS AND THE LIKE

(75) Inventor: Alessandro Frigerio, Capurso (IT)

(73) Assignee: Frigerio Tende da Sole S.R.L., Capurso (BA) (IT)

( * ) Notice: Subject to any disclaimer, the term of this patent is extended or adjusted under 35 U.S.C. 154(b) by 41 days.

(21) Appl. No.: 13/065,180

(22) Filed: Mar. 16, 2011

(65) Prior Publication Data

US 2011/0225913 A1 Sep. 22, 2011

(30) Foreign Application Priority Data

Mar. 18, 2010 (IT) ..... MI2010A0442

(51) Int. Cl.
*E04B 7/16* (2006.01)

(52) U.S. Cl.
USPC ..... 52/75; 52/302.1

(58) Field of Classification Search ..... 52/302.1, 52/73–75, 78, 79.6; 49/74.1
See application file for complete search history.

(56) References Cited

U.S. PATENT DOCUMENTS 4,527,355 A * 7/1985 Numakami et al. ..... 49/82.1
4,926,599 A * 5/1990 Scholz ..... 49/87.1
5,306,210 A * 4/1994 Smit ..... 454/250
5,732,507 A * 3/1998 Edwards ..... 49/74.1
5,839,233 A * 11/1998 Smit ..... 52/198
5,862,633 A * 1/1999 Van Ells ..... 52/16
7,335,096 B2 * 2/2008 Perez et al. ..... 454/358

* cited by examiner

*Primary Examiner* — Jeanette E Chapman
*Assistant Examiner* — Daniel Kenny
(74) *Attorney, Agent, or Firm* — Hedman & Costigan, P.C.; Kathleen A. Costigan

(57) ABSTRACT

An openable covering construction for pergolas and verandas, characterized in that said openable covering construction comprise a plurality of adjoining and partially overlapping bands longitudinally mounted on a supporting frame by a driving system allowing each said bands to be rotated about a longitudinal axis thereof parallel to a sloping side of said covering construction, said driving system driving said bands to at least two positions, a closed position, thereat said bands are partially overlapped onto one another and substantially parallel to the covering construction plane, and an opened position thereat each said band is rotated to a substantially vertical condition with respect to said covering plane, each said band comprising a section member including a contoured surface including, at a side thereof, a perpendicular side wall and, at an opposite side thereof, a channel defining curved wall, thereby a surface directly exposed to rain of said covering construction forms a water collecting and disposal of channel.

10 Claims, 4 Drawing Sheets

OPENABLE COVERING CONSTRUCTION FOR PERGOLAS, VERANDAS AND THE LIKE

BACKGROUND OF THE INVENTION

The present invention relates to an openable covering construction for pergolas, verandas and the like.

A number of systems designed for covering pergola structures and protecting them from sunrays and atmospheric agents have been already designed.

In particular, covering structures including a series of bands made of different materials and which are arranged parallel to one another and, in same cases, overlapping one another are well known.

In openable systems, the above mentioned bands may be rotatively driven about a longitudinal axis, thereby allowing to uncover an underlying area.

A driving system for operating said bands provides to mount said bands crosswise, that is with the axis of each band perpendicular to the inclination axis of the structure, said bands being driven by parallelogram driving mechanisms arranged on a side of the covering.

Prior openable covering systems, however, have the drawback of not assuring a good impermeability in a case of a large rainfall.

This problem occurs in particular as the inclination of the covering is less than 15°, since rainwater stagnates in water collecting channels formed between each band pair.

SUMMARY OF THE INVENTION

Accordingly, the aim of the present invention is to provide an openable covering construction for pergolas, verandas and the like, providing a perfect tightness even in a case of a large rainfall, and with a very small covering inclination angle.

Within the scope of the above mentioned aim, a main object of the invention is to provide such an openable covering construction for pergolas, verandas and the like assuring a very satisfactory runoff of rainwater while providing a rainwater barrier comparable to that of a continuous covering construction.

Another object of the present invention is to provide such an openable covering construction which, owing to its specifically designed features, is very reliable and safe in operation.

Yet another object of the present invention is to provide such an openable covering construction which may be easily made and which, moreover, is very competitive from a mere economic standpoint.

According to one aspect of the present invention, the above mentioned aim and objects, as well as yet other objects, which will become more apparent hereinafter, are achieved by an openable covering construction for pergolas, verandas and the like, characterized in that said openable covering construction comprises a plurality of adjoining and partially overlapping bands longitudinally mounted on a supporting frame by a driving system allowing each said band to be rotated about a longitudinal axis thereof parallel to a sloping side of said covering construction, said driving system allowing said bands to be arranged at at least two positions, a closed position, thereat said bands are partially overlapped onto one another and substantially parallel to the covering construction plane, and an opened position thereat each said band is rotated to a substantially vertical position with respect to said covering plane, each said band comprising a section member including a contoured surface including, at a side thereof, a perpendicular wall and, at an opposite side thereof, a channel defining curved wall, thereby a surface directly exposed to rain of said covering construction forms a water collecting and disposal of channel.

The water collecting efficiency of the above system derives from the fact that, as said system is in a closed condition thereof, it operates substantially as a conventional tile roof.

BRIEF DESCRIPTION OF THE DRAWINGS

Further characteristics and advantages of the present invention will become more apparent hereinafter from the following detailed disclosure of a preferred, though not exclusive, embodiment of the invention, which is illustrated, by way of an indicative, but not limitative, example in the accompanying drawings, where.

DESCRIPTION OF THE PREFERRED EMBODIMENTS

Figure 1:
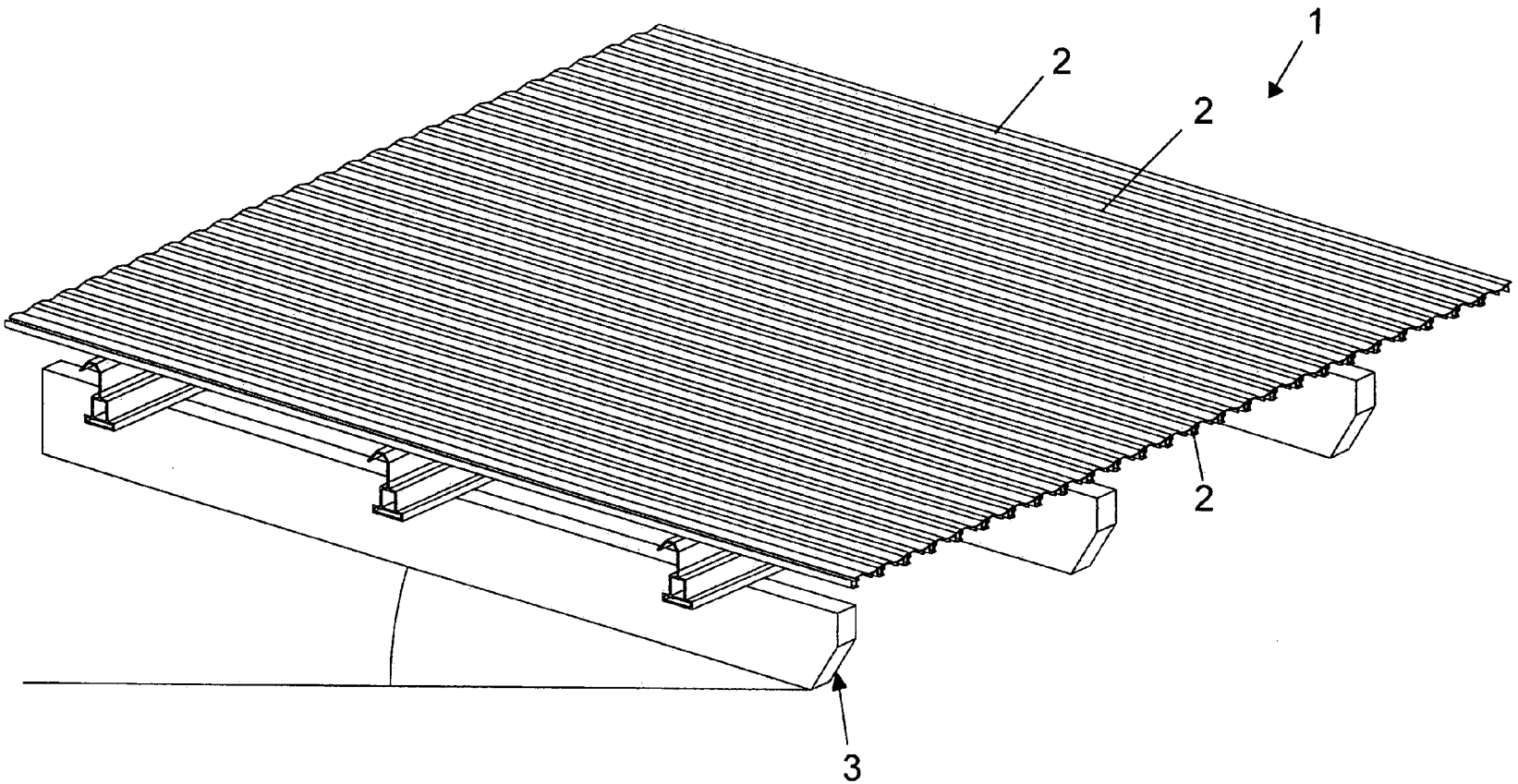
FIG. 1 is a perspective view of a portion of a covering construction according to the present invention.
Figure 2:
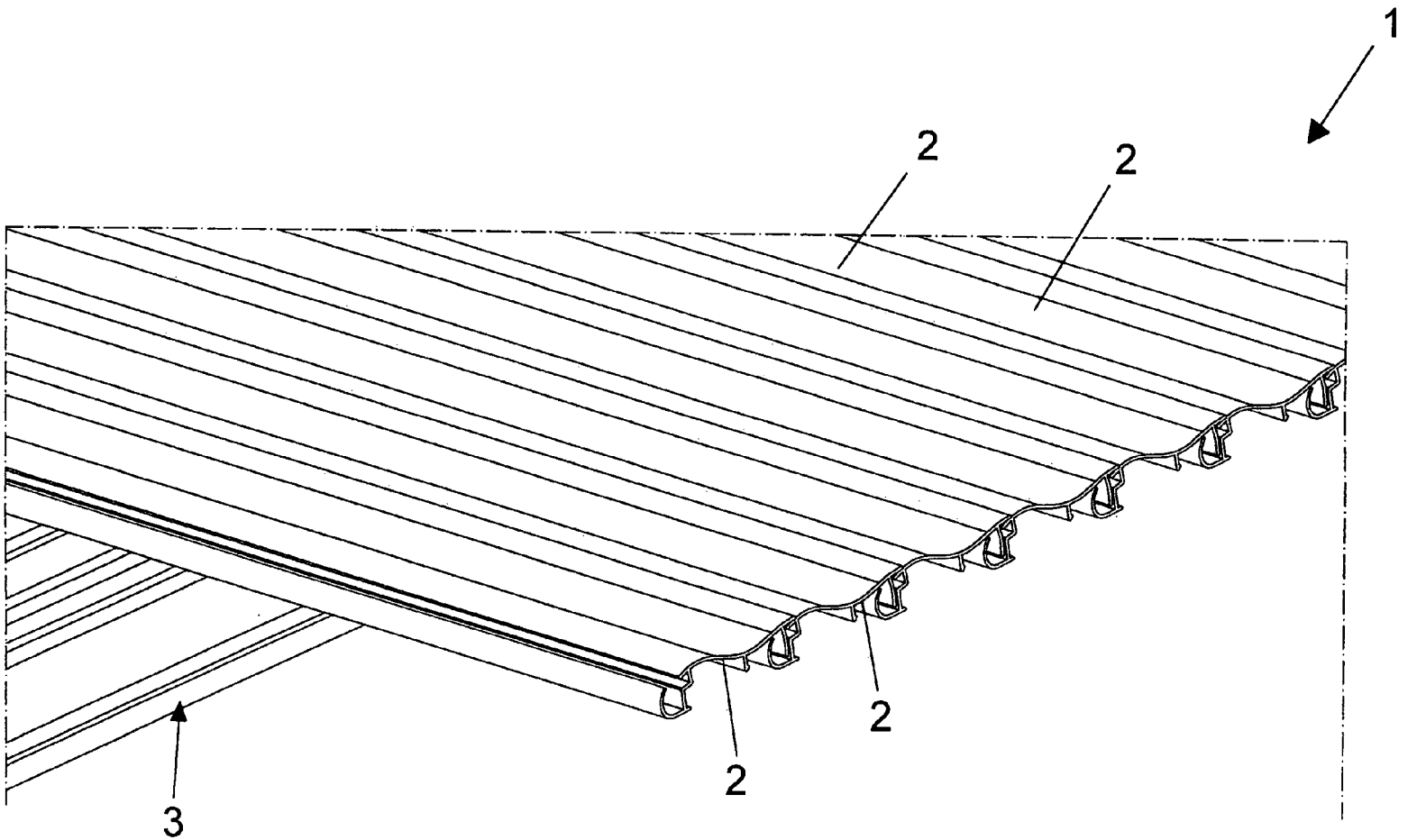
FIG. 2 is a further perspective view, on an enlarged scale showing a series or plurality of bands in a closed position thereof.
Figure 3:
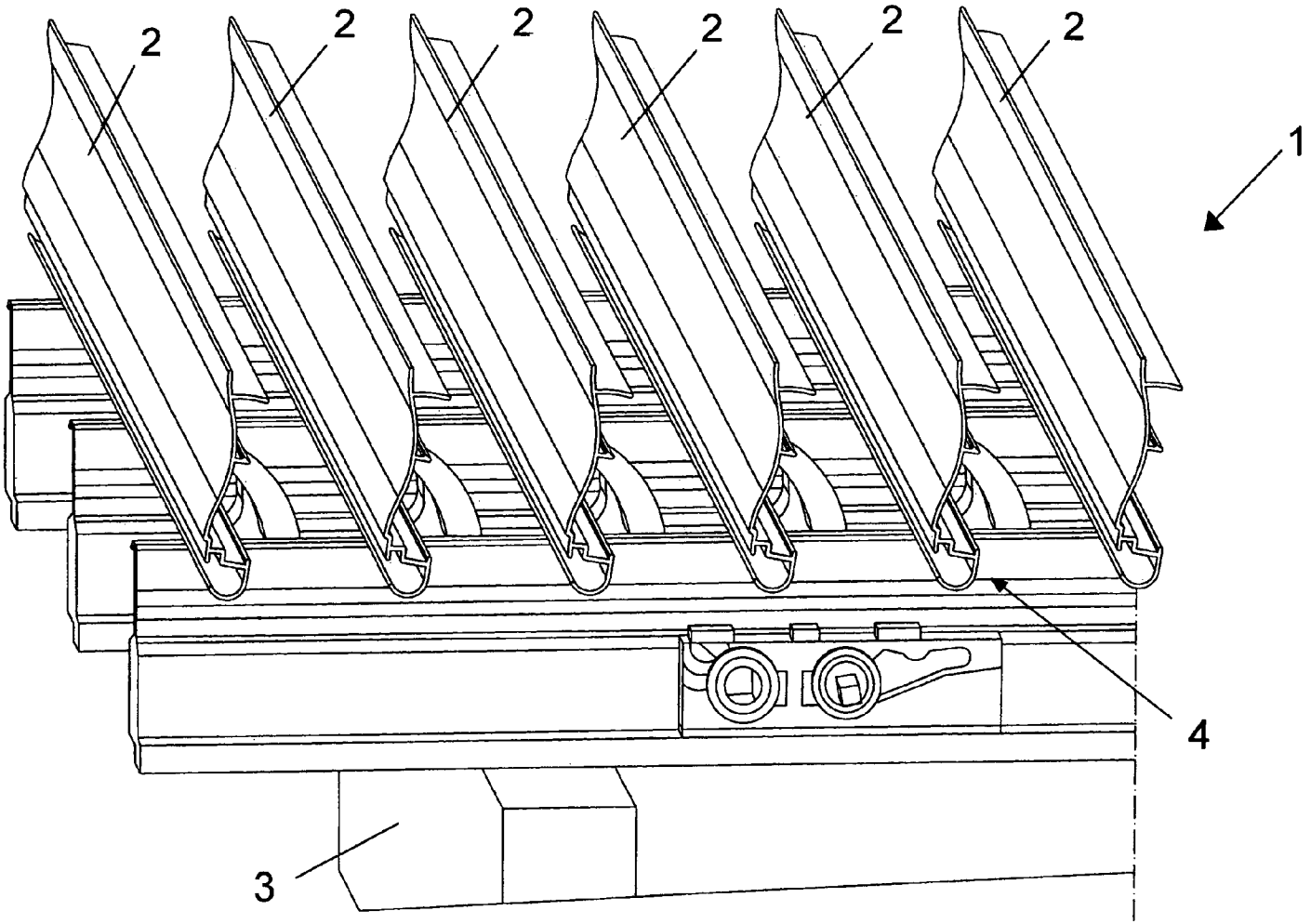
FIG. 3 is yet another perspective view, on a further enlarged scale, illustrating the details of the covering driving means with the covering bands being in an open position thereof.
Figure 4:
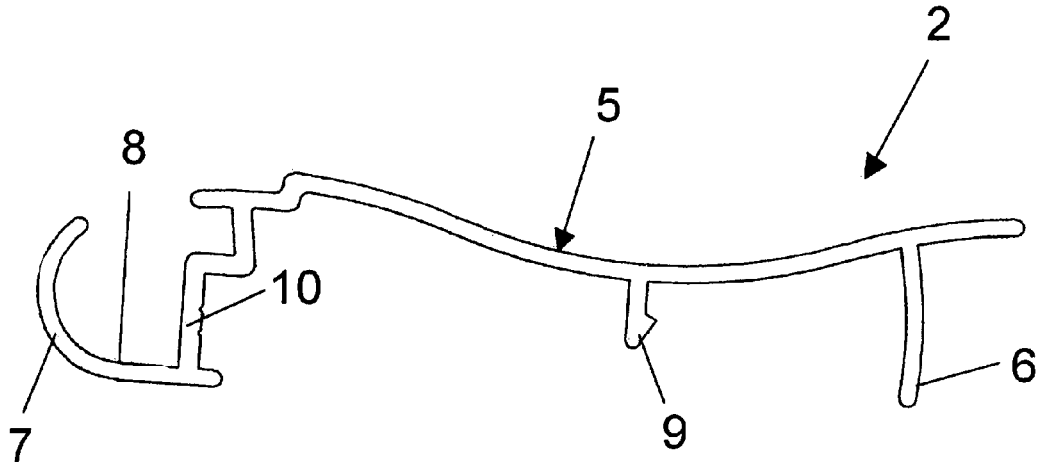
FIG. 4 is a cross-sectional view of a covering band made according to the present invention.

With reference to the number references of the above mentioned figures, the openable covering construction, according to the present invention, which has been generally indicated by the reference number 1, comprises a plurality of covering bands 2, adjoining one another, being partially overlapped onto one another and longitudinally mounted on a supporting framework 3 through a driving system, which has been generally indicated by the reference number 4.

Said driving system 4, which may be an already existing driving system, allows to rotatively drive each band 2 about a longitudinal axis thereof, which longitudinal axis is parallel to the sloping or inclination of the covering 1.

The driving system, in particular, allows said bands to be arranged at at least two positions, that is a closed position thereat the bands are partially overlapped and substantially parallel to the covering plane, and an open position, thereat each said band is turned to a substantially vertical condition or position, with respect to the covering plane.

According to the present invention, each said band comprises a section member including a contoured surface 5 having, on a side, a perpendicular wall 6 and, on the other side, a curved wall 7 defining a channel 8.

A central element 9 operates as a connecting element for the driving system the band 2 is applied to.

The covering surface 5 which is directly exposed to the rain is concave and provides a channel pattern having a high rainwater collecting and disposal of capability.

By assembling the bands 2 parallel to the axis extending from upward to downward of the covering, a small inclination, for example of 4°, to assure collected rainwater to be easily caused to run-off will be sufficient.

In fact, the channel 8, which is not directly exposed to the rainfall, with the covering construction is in a closed condition thereof, has a sufficiently large cross-section and a semicircular configuration, thereby collecting drained water which has not been already drained by the concave surface 5, to discharge said water downward.

Owing to the inward curved configuration of the water collecting channel 8, water cannot overflow outside said channel, with the covering both in a fully closed and in a partially closed condition thereof.

The perpendicular wall 6, operating as a wind cutting arrangement, is so extended as to arrive at the bottom of the channel 8 of the adjoining band, with the covering in a closed condition.

Advantageously, the perpendicular band wall is slightly bent as to prevent any interference of said bands as said structure is opened and closed from occurring.

More specifically, the openable covering construction 1 is further characterized in that each said band 2, forming said covering, comprises a deep and high volume channel 8, which is defined, both by a upward and an inward curved wall 7 and a vertical wall 10.

In the openable covering construction according to the present invention, each band 2 has a downward projecting convexity 9 defining a further water draining main channel, extending in a longitudinal direction, since said bands 2 are longitudinally inclined.

Thus, the specifically designed configuration of the band 2 contour allows the inventive covering system, in a closed condition thereof, to provide a full impermeability starting from a minimum inclination) (4°) of the covering.

A good protection from rain is moreover assured even when the covering bands are arranged with an opening of about 5° for allowing air to circulate therethrough.

It has been found that the invention fully achieves the intended aim and objects.

In fact, the invention has provided a covering construction formed by a plurality of bands having such a contour allowing said bands to be mounted in parallel to the upward to downward extending axis of the covering, thereby rainwater, even in a comparatively high amount, may be quickly drained, and this with a minimum inclination of only 4° of the covering system.

As stated, the efficiency of the inventive covering, in a closed condition thereof, is due to the fact that it is operatively similar to a conventional tile roof.

In practicing the invention, the used materials, as well as the contingent size and shapes, can be any, depending on requirements.

The invention claimed is:

1. An openable covering construction for pergolas and verandas, characterized in that said openable covering construction comprises a plurality of adjoining and partially overlapping bands longitudinally mounted on a supporting frame by a driving system allowing each said bands to be rotated about an axis thereof parallel to a covering construction inclination axis, said driving system driving said bands to at least two positions, a closed position, thereat said bands are partially overlapped onto one another and substantially parallel to the covering construction plane, and an opened position whereat each said band is rotated to a substantially vertical condition with respect to said covering plane, each said band comprising a section member including a contoured surface including, at a side thereof, a perpendicular side wall and, at an opposite side thereof, a channel defining curved wall, whereby a surface directly exposed to rain of said covering construction forms a channel for collecting and disposal of water.

2. An openable covering construction, according to claim 1, characterized in that each said band comprises a central element operating as a connection element for the driving system each said band is applied to.

3. An openable covering construction, according to claim 1, characterized in that said bands are mounted parallel to an axis extending from upward to downward of said covering construction and are slanted at a minimum slanting angle of 4°.

4. An openable covering construction, according to claim 1, characterized in that said water collecting and disposal of channel has such a cross section semicircular configuration as to collect therein and downward discharge therefrom drained water not disposed of from said concave surface.

5. An openable covering construction, according to claim 1, characterized in that said channel of each said band has an inward curved configuration to prevent water from exiting said channel both with said covering construction in a fully closed condition and in a partially closed condition thereof.

6. An openable covering construction, according to claim 1, characterized in that a perpendicular wall of said band operates as a nose cowling element extending to a bottom of a said channel of an adjoining band, with said covering construction arranged in a closed condition thereof.

7. An openable covering construction, according to claim 6, characterized in that said perpendicular band wall is slightly bent so as to prevent any interferences of said bands, as said structure is opened and closed, from occurring.

8. An openable covering construction, according to claim 1, characterized in that each said band comprises a high water collecting capability deep channel delimited by an upward and inward channel wall, and by a further channel vertical wall.

9. An openable covering construction, according to claim 1, characterized in that each said band comprises a downward extending convexity defining a further rainwall draining main channel, causing said water to longitudinally flow in cooperation with the longitudinal inclination of said bands.

10. An openable covering construction, according to claim 1, characterized in that said construction provides an efficient protection against rain even with said bands thereof arranged at a position opened at about 5° for allowing air to circulate therethrough.

* * * * *